United States Patent [19]

Tsuchida

[11] 4,195,684

[45] * Apr. 1, 1980

[54] APPARATUS FOR MULTI-STRAND CONTINUOUS CASTING

[75] Inventor: Yutaka Tsuchida, Yokosuka, Japan

[73] Assignee: Ishikawajima-Harima Jukogyo Kabushiki Kaisha, Tokyo, Japan

[ * ] Notice: The portion of the term of this patent subsequent to , has been disclaimed.

[21] Appl. No.: 860,941

[22] Filed: Dec. 15, 1977

Related U.S. Application Data

[62] Division of Ser. No. 750,437, Dec. 14, 1976, Pat. No. 4,149,583.

[30] Foreign Application Priority Data

Dec. 18, 1975 [JP] Japan ..... 50/151589

[51] Int. Cl.[2] ..... B22D 11/04

[52] U.S. Cl. ..... 164/416; 164/420

[58] Field of Search ..... 164/260, 416, 420, 442, 164/83; 209/366; 366/110; 310/80

[56] References Cited

U.S. PATENT DOCUMENTS

| | | | |
|---|---|---|---|
| 1,607,811 | 11/1926 | Blum | 366/110 |
| 3,200,456 | 8/1965 | Harter, Jr. et al. | 164/416 X |
| 3,292,215 | 12/1966 | Taylor et al. | 164/416 |
| 3,347,308 | 10/1967 | Saunders | 164/420 |
| 3,395,751 | 8/1968 | Hess | 164/260 |
| 3,435,879 | 4/1969 | Greenberger | 164/83 |
| 3,612,156 | 10/1971 | Schoffmann | 164/260 |
| 3,696,860 | 10/1972 | Colombo | 164/416 X |
| 3,782,446 | 1/1974 | Walter | 164/260 |
| 3,886,995 | 6/1975 | Bollig et al. | 164/260 |
| 4,036,284 | 7/1977 | Hoffmann | 164/442 |
| 4,057,099 | 11/1977 | Danieli | 164/260 |

FOREIGN PATENT DOCUMENTS

| | | | |
|---|---|---|---|
| 458384 | 3/1975 | U.S.S.R. | 164/442 |

*Primary Examiner*—Robert D. Baldwin
*Assistant Examiner*—J. Reed Batten, Jr.
*Attorney, Agent, or Firm*—Scrivener, Parker, Scrivener and Clarke

[57] ABSTRACT

Disclosed is an apparatus for multi-strand continuous casting wherein a plurality of strands may be spaced apart from each other by a distance only dependent upon the dimensions of a copper plate and water-cooling jacket of a mold because a multi-strand mold oscillation mechanism may be installed independently of the spacing between the adjacent strands and the amplitude of oscillation of each mold may be suitably adjusted depending upon the casting conditions but independently of each other. Cast products emerging from the molds are withdrawn through a multi-strand roll apron or bending unit, a multi-strand casting bow, a multi-strand straightener and a multi-strand table by a multi-strand-pinch-roll stand consisting of a plurality of coaxial multi-pinch-roller assemblies, the individual pinch rollers in each assembly being driven independently of each other.

2 Claims, 18 Drawing Figures

FIG. 2
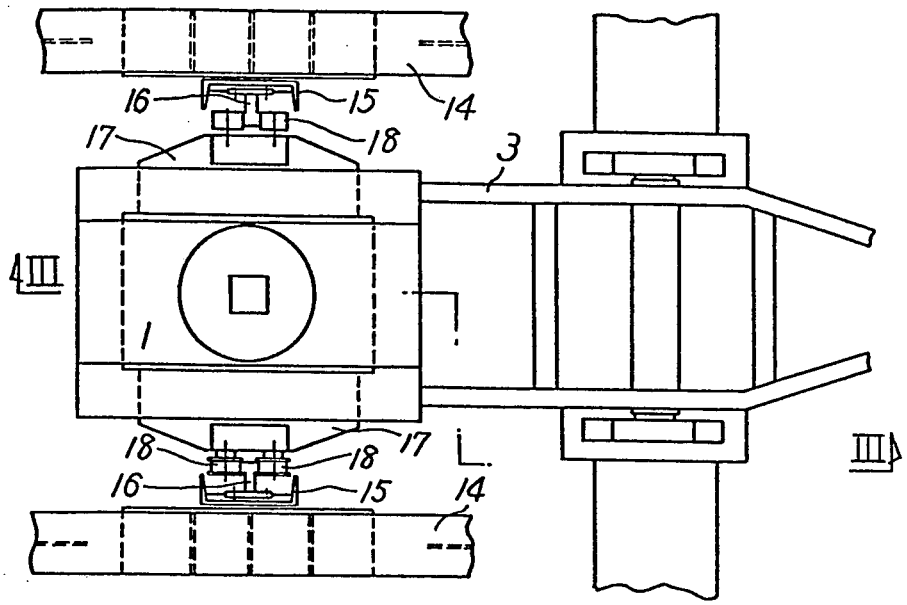
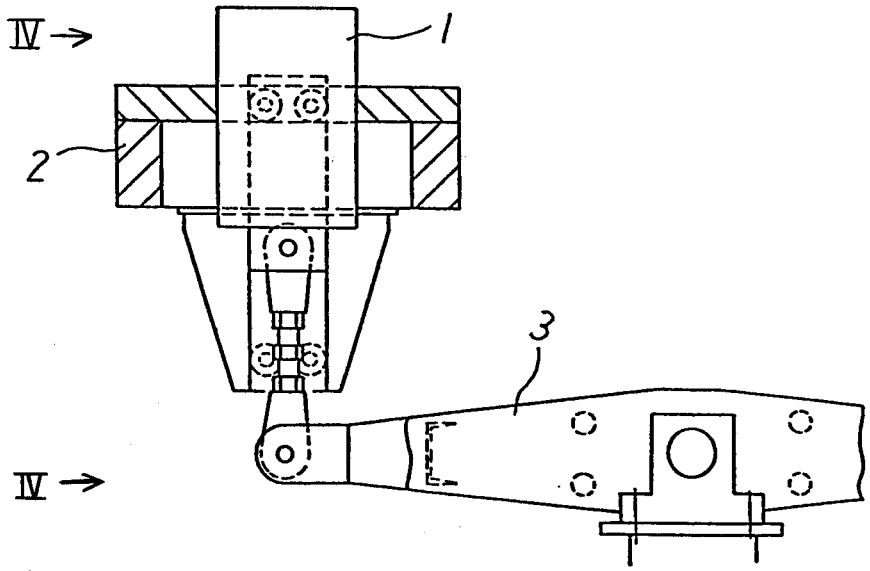
FIG. 3

FIG. 6
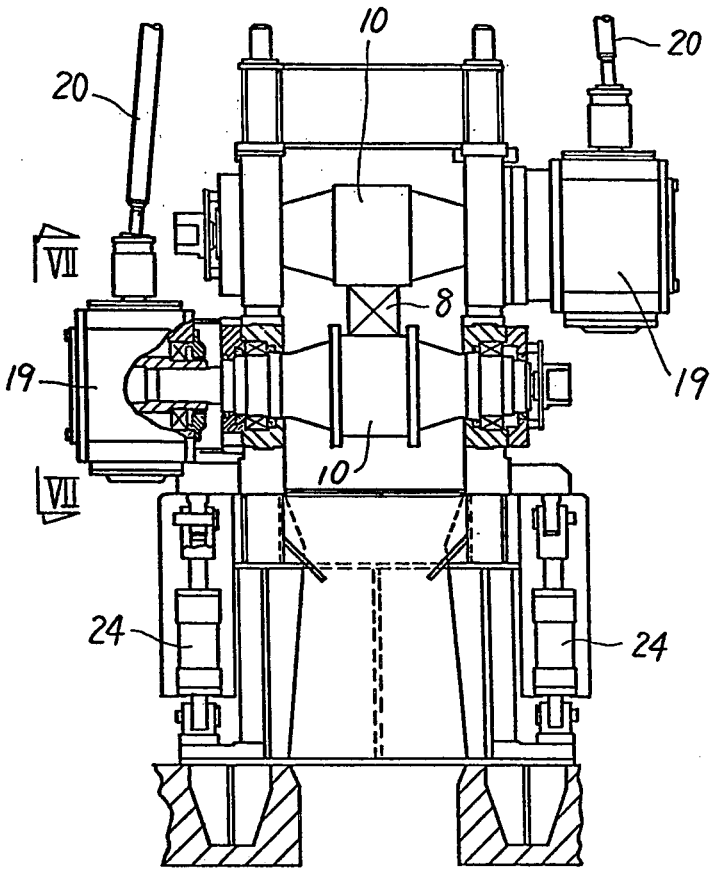
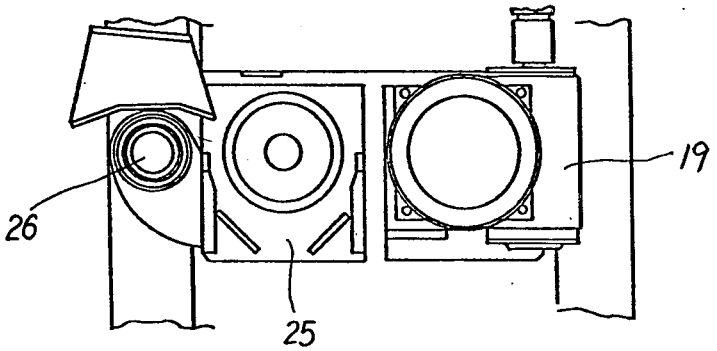
FIG. 7

(A)

(B)

FIG. 10
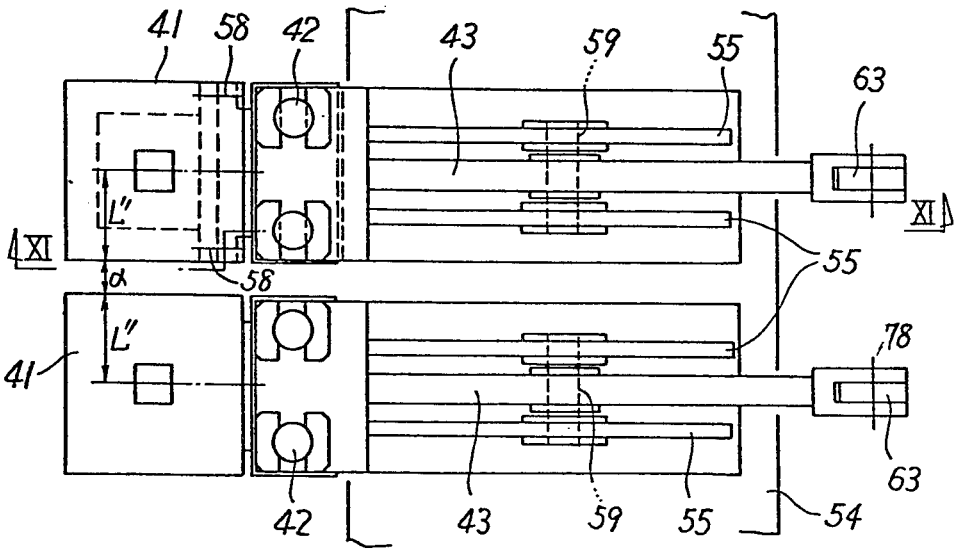
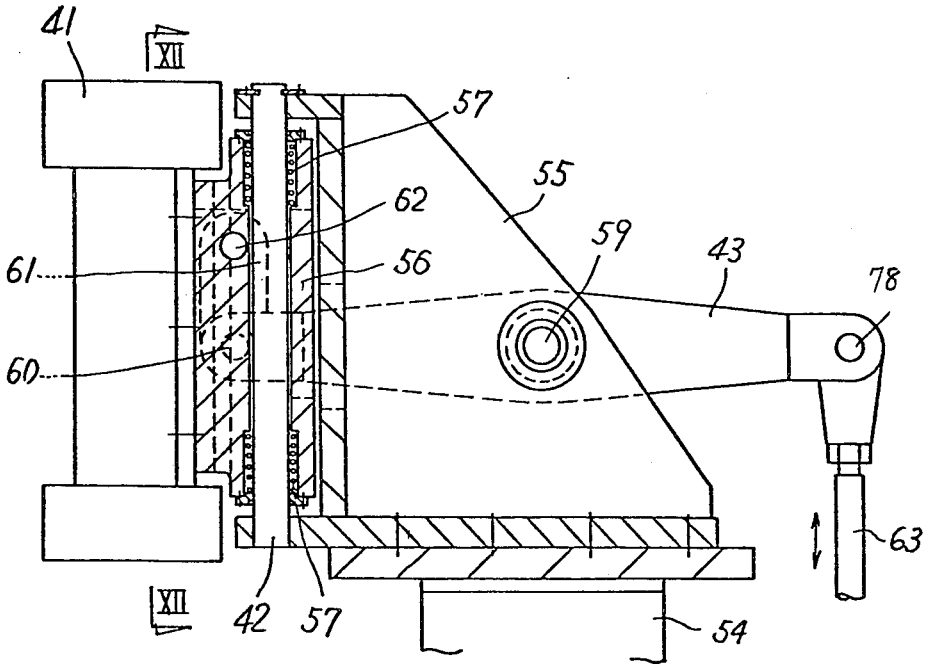
FIG. 11

APPARATUS FOR MULTI-STRAND CONTINUOUS CASTING

This is a division of application Ser. No. 750,437 filed Dec. 14, 1976 and now U.S. Pat. No. 4,149,583 issued Apr. 17, 1979.

DETAILED DESCRIPTION OF THE INVENTION

With the increase in capacity of a steel refining furnace, multi-strand apparatus for continuous casting have been increasingly used for continuous casting of semi-products of steel such as billets, blooms, slabs and so on, but the prior art multi-strand apparatus for continuous casting is nothing but an agglomeration of a plurality of single-strand apparatus so that a large installation space is required, the initial cost is very expensive and it includes a large number of various parts, resulting in very complex maintenance.

Twin- or triple-continuous-casting apparatus has been also used for producing slabs continuously. In one prior art twin-continuous-casting apparatus, two molds are mounted on a common oscillation table which in turn is driven by a common oscillation drive, and slabs emerging from the molds are withdrawn by one pair of pinch rolls. However, it is extremely difficult to pinch two blooms and slabs with a uniform pressure. Furthermore when casting is started, two blooms and slabs must be simultaneously withdrawn while the molds are oscillated so that molten metal must be poured into the molds simultaneously within the same time interval and in the same volume and consequently the casting operation is extremely difficult.

Meanwhile, the continuous casting speed is limited because of the problem of break-out. Therefore, in order to increase the production, there has been devised and demonstrated a process and apparatus wherein a plurality of strands are installed so that the whole production is in proportion to the number of strands. An apparatus having as many as 8 strands has been already in operation, but these strands each having the same units, devices and equipment for continuous casting are merely disposed in parallel with each other so that there is a limit to the reduction in spacing or distance between the adjacent strands especially due to the pinch roll stands. For instance, the spacing is 1,100 to 1,300 mm in case of the existing apparatus for continuous casting of billets of 120 mm square.

With the increase in spacing between the adjacent strands, the tundish is also increased in length so that the distance between the pouring position and the outermost nozzle is increased accordingly and consequently the temperature of molten steel reaching the outermost nozzle drops considerably. As a consequence, the clogging of the nozzle occurs. In order to overcome this problem, in the 8-strand continuous casting apparatus, two tundishes are used, but the increase in maintenance cost results and the nozzle clogging problem has not been satisfactorily solved yet so that the nozzle clogging occurs still frequently, adversely affecting the operation.

Next referring to FIG. 1 the prior art process and apparatus for multistrand continuous casting will be described. Since two strands are substantially similar in both construction and mode of operation, only one strand will be described. A water-cooled copper mold 1 with a copper plate is mounted on an oscillation table 2 which is vertically oscillated through an oscillation lever by a mold oscillation drive 4. More specifically, a drive motor 4-3 drives through a reduction gear 4-2 an eccentric cam shaft 4-1 so that an oscillation lever 4—4 swings through a predetermined angle in a vertical plane and consequently the oscillation lever 3 swings, oscillating vertically the mold table 2 and hence the mold 1. Therefore the sticking of molten steel to the mold wall may be prevented.

A billet 8 which continuously emerges from the mold 1 is guided by an roller apron called a bending unit 5 and another roller apron called a casting bow 6 toward a straightener 7 where the curved billet 8 is straightened. The straightened slab 8 is withdrawn over a horizontal table 9 by pinch rollers 10 which in turn are driven by pinch roll drives 11. Thereafter, the billet 8 is cut into a predetermined length by a shear 12 which is moved by a hydraulic or pneumatic cylinder 13 at the same speed with the withdrawing speed of the billet 8. At the downstream of the shear 12 there is installed a transfer table (not shown).

Next referring to FIGS. 2, 3 and 4, the mold 1, mold oscillation table 2 and oscillation lever 3 will be described in more detail. Disposed on each lateral side of the mold oscillation table 2 is a stationary frame 14 which supports a guide rail support 15 which in turn supports a vertical guide rail 16. Supported securely on each lateral side of the oscillation table 2 is a guide roll support 17 which in turn supports guide rolls 18 riding on the flange of the guide rail 16. Therefore the oscillation table 2 may be prevented from oscillating in the lateral directions, that is, the table 2 is oscillated only in the vertical direction.

In the prior art apparatus, guide means consisting of the stationary frame 14, the guide rail support 15, the guide rail 16, the guide roll support 17 and the guide rollers 18 described above is disposed on each side of the oscillation table 2 in each strand, occupying a relatively large installation space. As a result, each strand has a greater width which is equal to twice as wide as a length L shown in FIG. 4 and is considerably greater than the radius L' of the mold 1. In addition, much limitations have been imposed on the designs of the mold oscillation drive 4 for vibrating the oscillation lever 3 because the reduction gear 4-2, the motor 4-3 and so on must be disposed within the limited width of each strand.

Next the pinch rolls 10 including their drives 11 will be described in detail. As shown in FIG. 1, each pinch roll 10 is driven by its own drive 11 which is shown in detail in FIGS. 5, 6 and 7. That is, in a continuous casting machine having more than two strands, these pinch roll drives are disposed above their corresponding pinch rolls 10 and are drivingly coupled to them through worm gearings.

Referring to FIGS. 5, 6 and 7, the pinch roll 10 is drivingly coupled to a motor 23 through a first worm gearing 19, a universal shaft 20, a miter gearing 21 and a second worm gearing 22. A bearing block 25 of the pinch roll 10 is rotatable about a pin 26 by a hydraulic or pneumatic power cylinder 24. With these pinch roll drives, therefore, the strand width cannot be decreased because the worm gearings and bearing blocks of one strand would interfere with those of the adjacent strands if the width were decreased.

As described previously, with the increase in capacity of a steel making furnace; that is, with the increase in production capacity, the continuous casting strands are also increased in number, reaching eight strands in an extreme case. However, the space requirement for the mold oscillation drives and the mold roll drives imposes a limit on the reduction in spacing between the adjacent strands so that an extremely large space is required for the installation of a multi-strand continuous casting machine. Furthermore each strand has its own roller aprons so that the replacement thereof requires a long time and many labors. In addition, the prior art continuous casting has the problem that the alignment step takes also a long time.

Meanwhile, as described previously, the temperature drop of molten steel results in the clogging of a tundish nozzle, and in order to overcome this problem, two tundishes are used in a six- or eight-strand machine, but the maintenance thereof costs much and takes a long time as will be described in detail with reference to FIGS. 8(A) and 8(B). FIG. 8(A) shows an arrangement for 6 strands whereas FIG. 8(B), for 8 strands, wherein reference numeral 27 denotes tundishes; 28, a ladle; 29, molten steel pouring positions; 30, nozzles; and $l_1$ and $l_2$, spacings between the adjacent strands. It is readily seen that the farther from the ladle 28 or the molten steel pouring position the nozzles 30 are, the more frequently their clogging occurs, resulting in the serious damages to the continuous casting line. However, this problem has not solved yet.

In view of the above, the present invention has for its object to overcome the above and other problems encountered in the prior art process and apparatus for continuous casting, and will become apparent from the following description of one preferred embodiment thereof taken in conjunction with the accompanying drawings, in which:

FIG. 2 is a plan view of a mold oscillation table thereof;

FIG. 3 is a side view, partly in cross section, viewed in the direction indicated by the arrows III of FIG. 2;

FIG. 6 is a front view, partly broken, thereof;

FIG. 7 is a view taken along the line VII—VII of FIG. 6;

Figure 8:
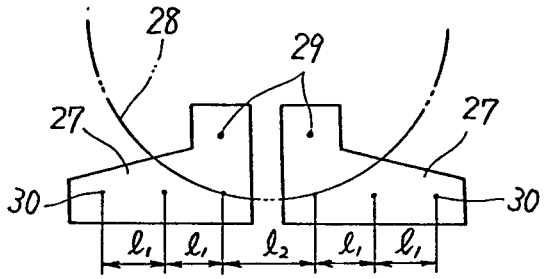
Figure 8:
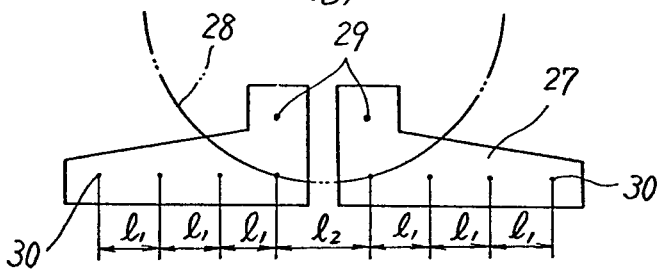
Figure 9:
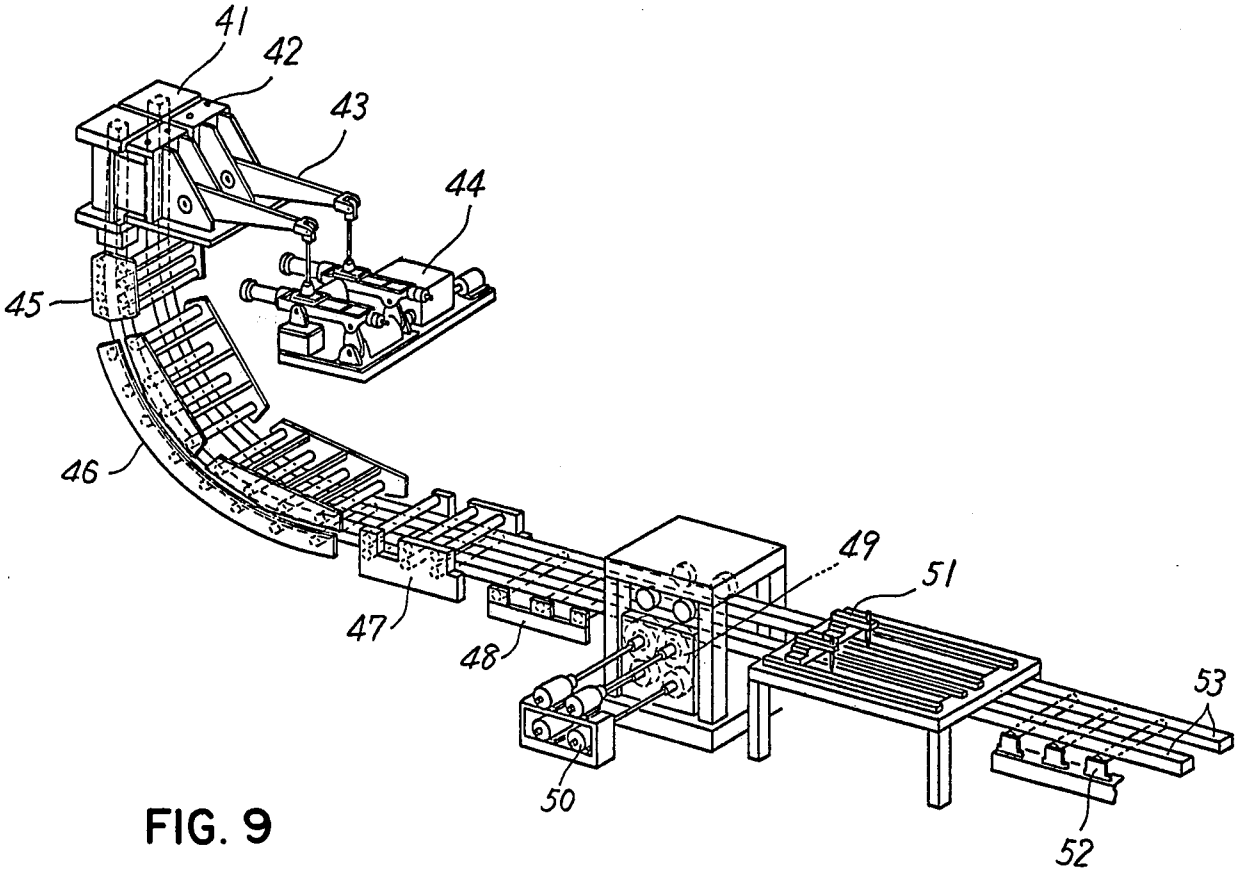
Figure 12:
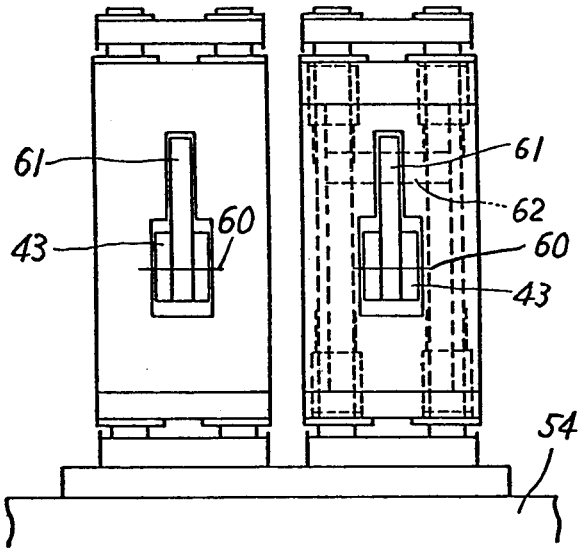
Figure 13:
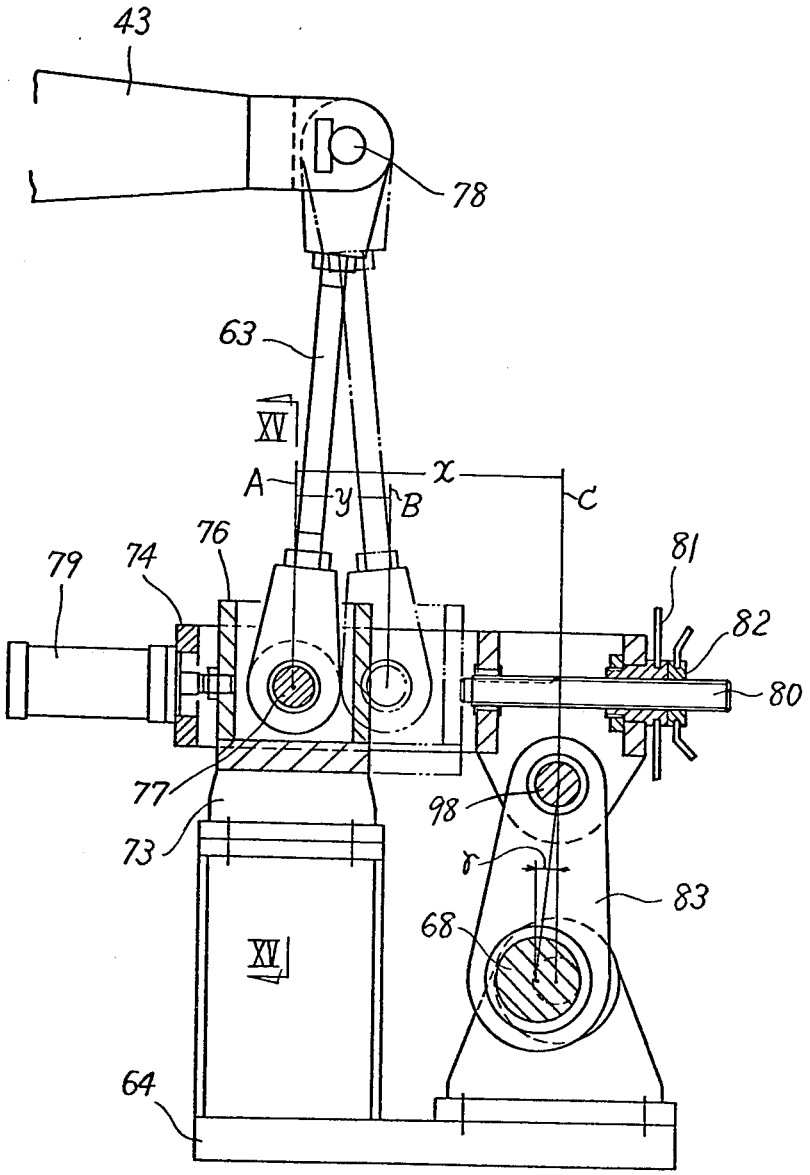
Figure 14:
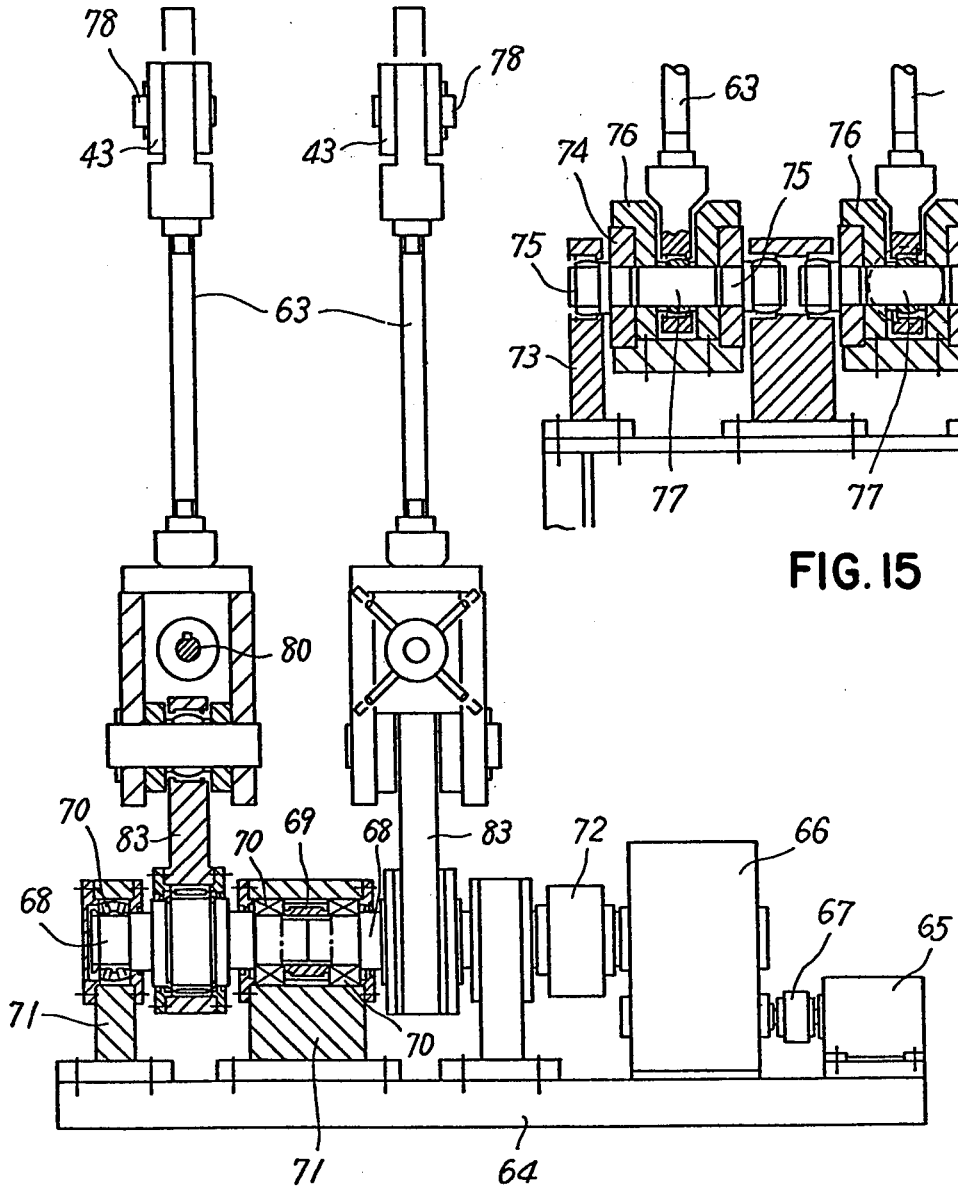
Figure 15:
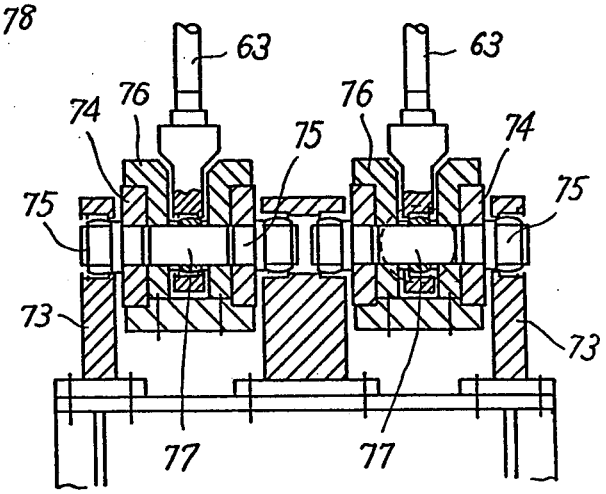
Figure 16:
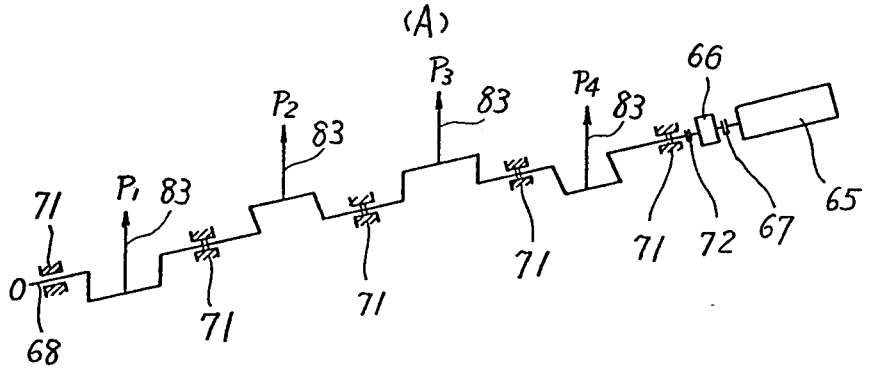
Figure 16:
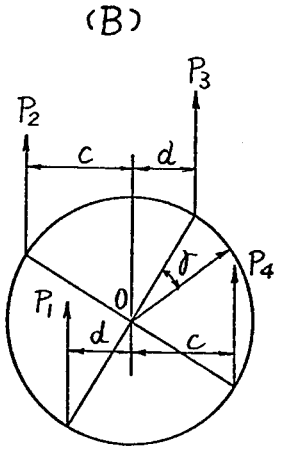
Figure 17:
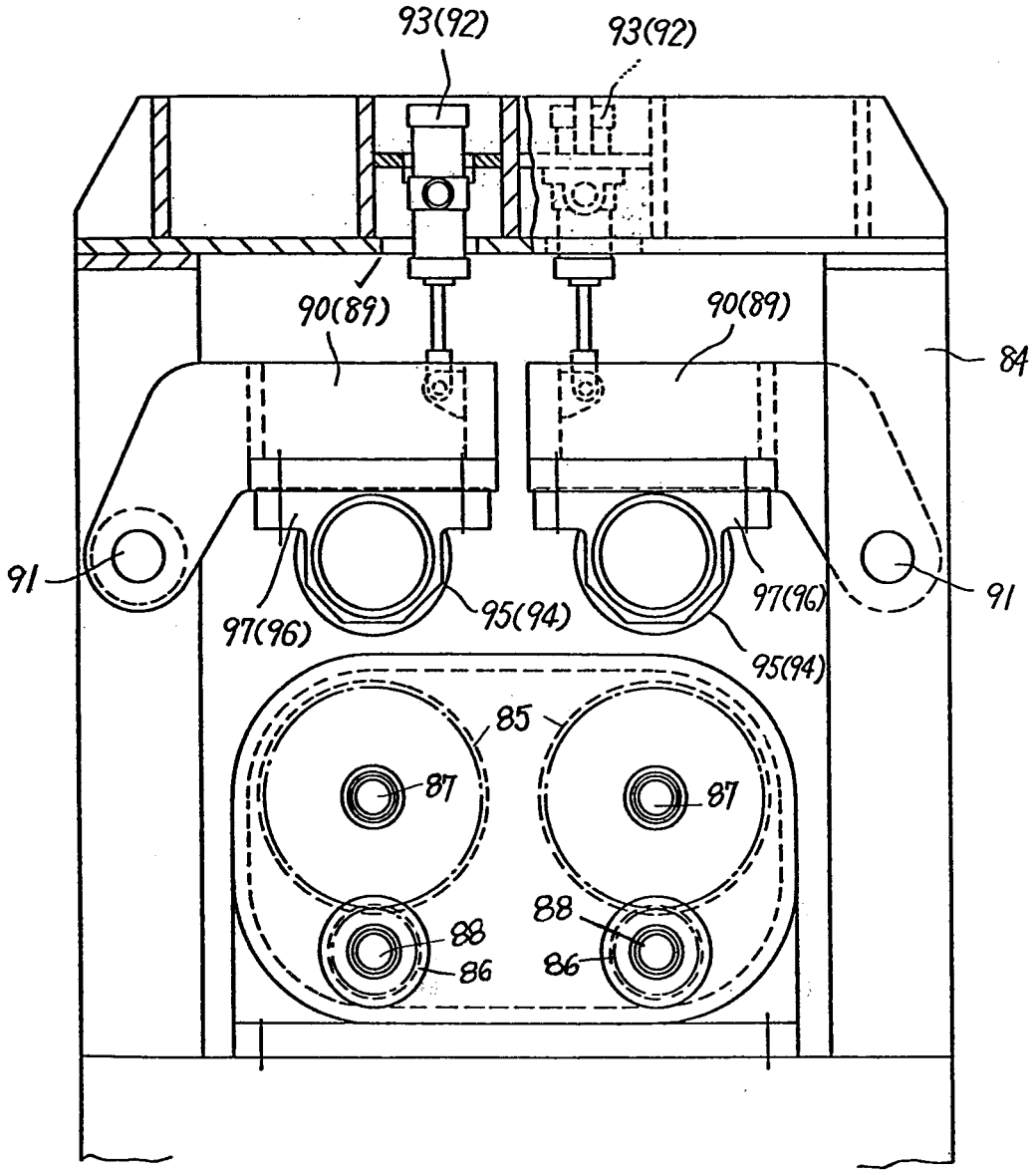
Figure 18:
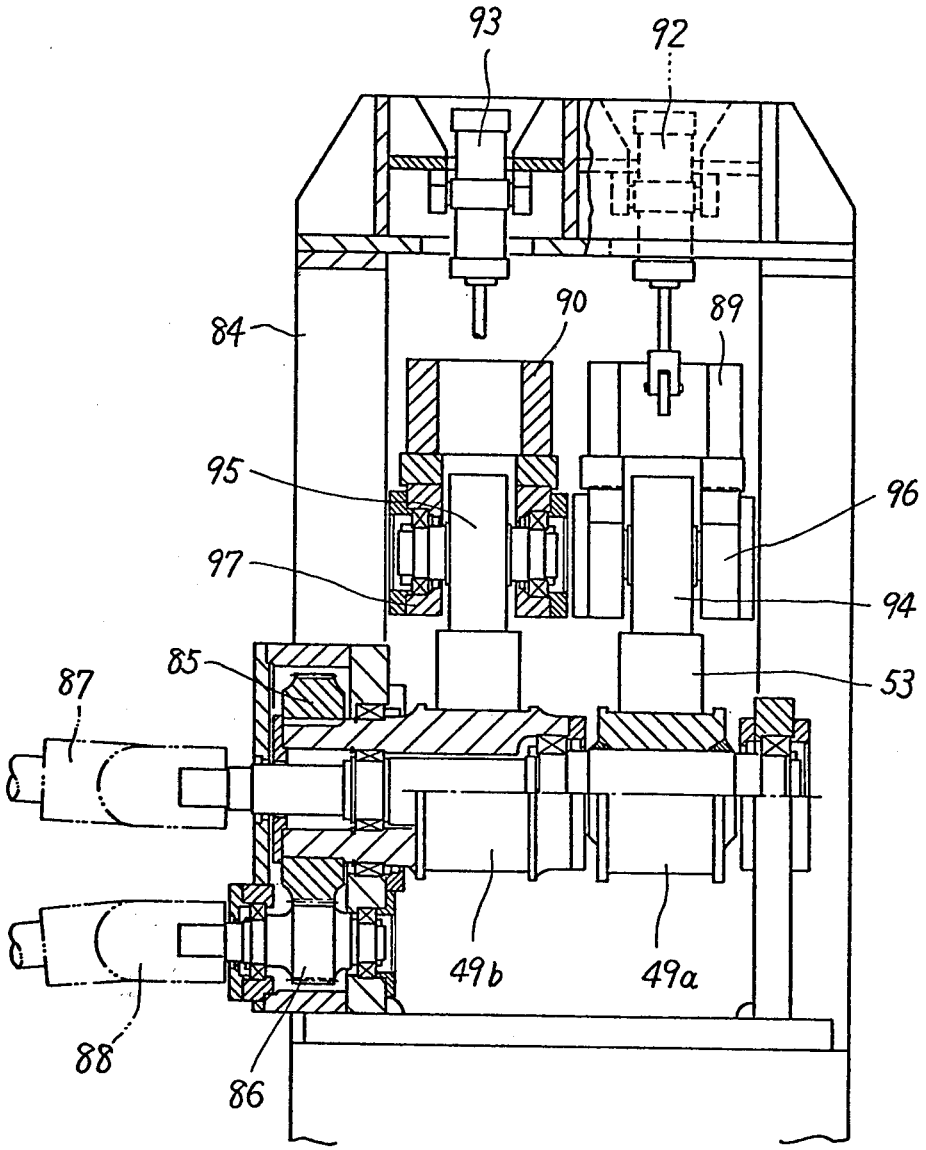

FIGS. 8(A) and 8(B) show arrangements of tundishes for 6- and 8-strands, respectively;

FIG. 9 is a perspective view used for the explanation of a process and apparatus for multi-strand continuous casting in accord with the present invention;

FIG. 10 is a plan view of a mold oscillation mechanism in accord with the present invention;

FIG. 11 is a side view looking in the direction indicated by the arrows XI of FIG. 10;

FIG. 12 is a front view looking in the direction indicated by the arrows XII of FIG. 11;

FIG. 13 is a side view, partly in section, of a mold oscillation drive in accord with the present invention;

FIG. 14 is a front view, partly in section, thereof;

FIG. 15 is a sectional view taken along the line XV—XV of FIG. 13;

FIGS. 16(A) and 16(B) are views used for the explanation of the underlying principle of the mold oscillation drive;

FIG. 17 is a side view of a pinch roll assembly in accord with the present invention; and FIG. 18 is a longitudinal sectional view of FIG. 17.

In FIG. 9 there is shown in perspective view a continuous casting apparatus having two strands in accord with the present invention, but it will be understood that it may have as many strands as required. A water-cooled, copper mold 41 with a copper plate is guided with guide pins 42 only for the vertical reciprocal movement and is drivingly coupled through oscillation levers 43 to a multi-strand-mold oscillation drive 44. Molten steel is poured into the mold 41 and a billet emerging from the mold 41 is guided by a bending unit 45 and a casting bow 46 toward a straightener 47 and then to a horizontal table 48. These bending unit 45, casting box 46, straightener 47 and horizontal table 48 are so designed and constructed as to handle simultaneously a plurality of billets being cast so that they shall be sometimes referred to as "the multi-strand units" in this specification. These multi-strand units have various advantages. For instance, as compared with the corresponding single-strand units shown in FIG. 1, the replacement of multi-strand units may be much facilitated, and the alignment step may be much simplified. As a result, the maintenance may be considerably facilitated; initial preparation time may be remarkably reduced; and the productivity may be significantly improved. Thus in addition to the technical advantages various economical advantages result.

The billets are withdrawn by a multi-strand pinch roll unit 49 which is driven by a multi-strand-pinch-roll drive unit 50, and are cut into a predetermined length by torch cutters 51. The cutout billets 53 are discharged by a discharge table 52.

Figure 1:
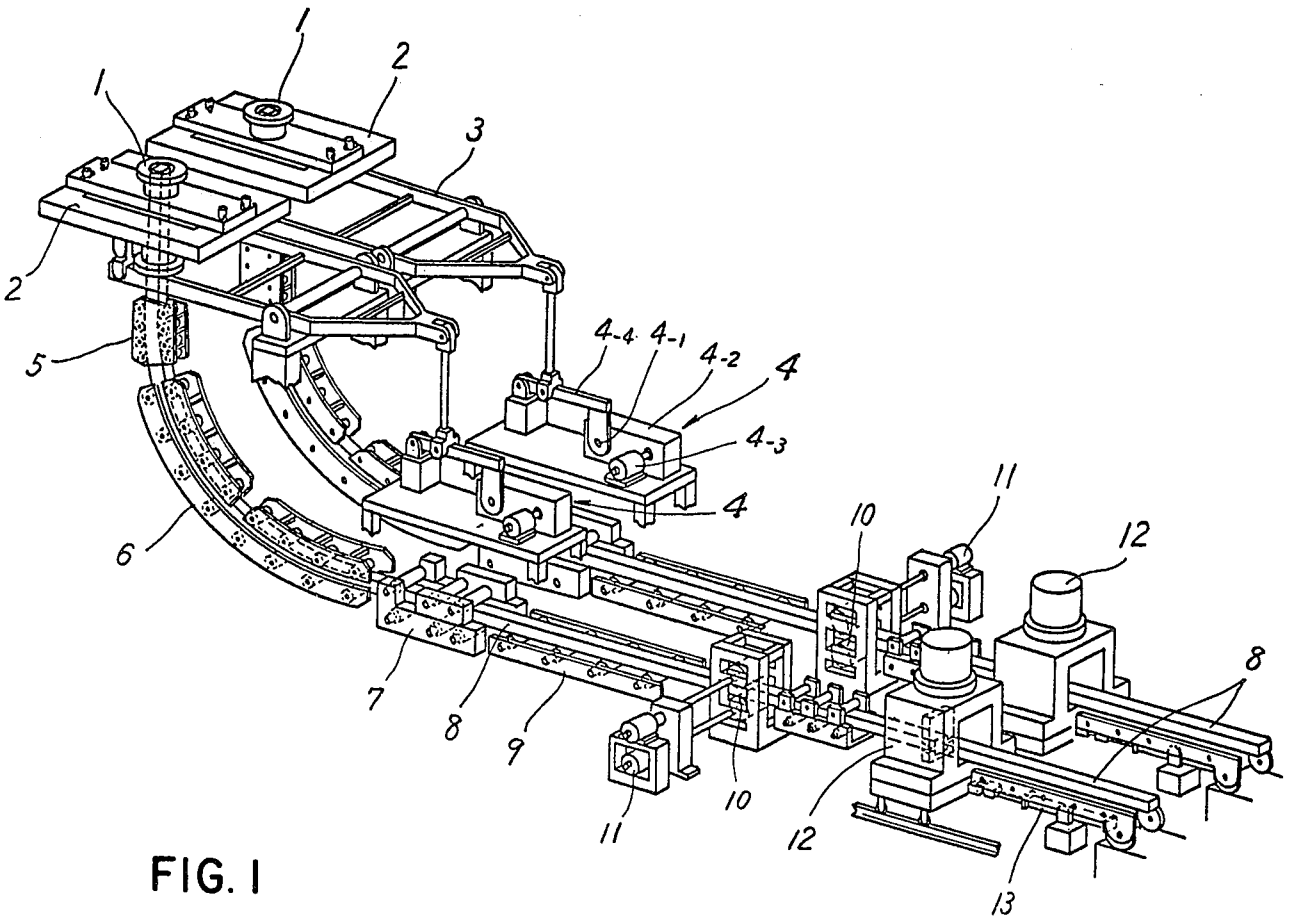
FIG. 1 is a perspective view of a prior art continuous casting apparatus.
Figure 4:
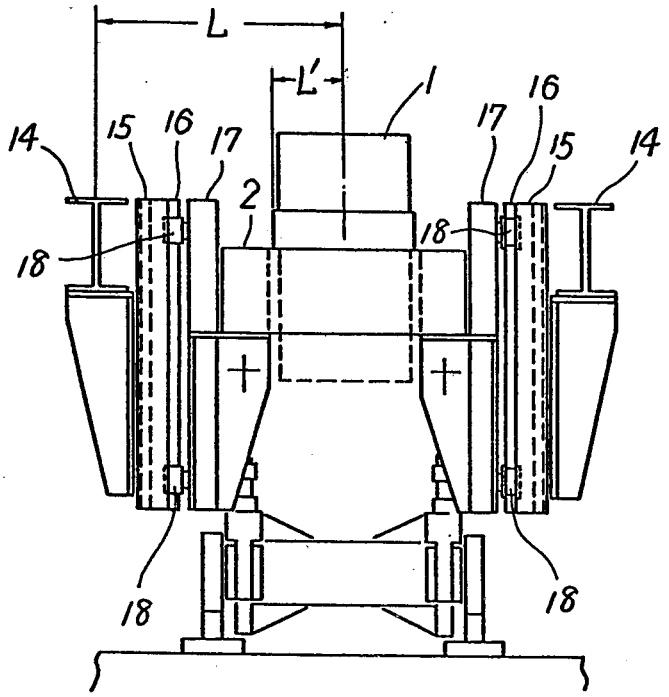
FIG. 4 is a front view viewed in the direction indicated by the arrows IV of FIG. 3.
Figure 5:
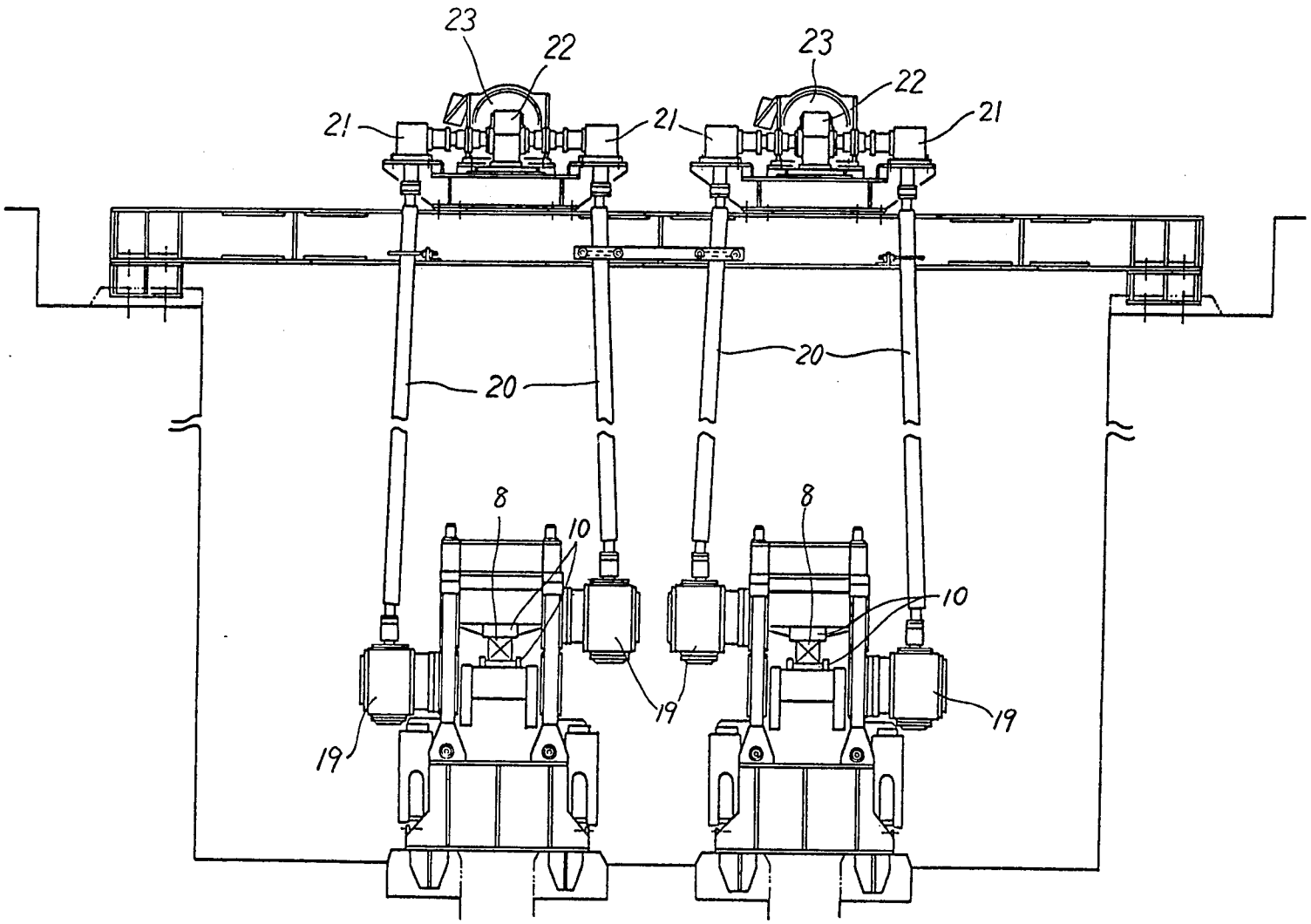
FIG. 5 is a front view of pinch rolls of the apparatus shown in FIG. 1.

Next referring to FIGS. 10, 11 and 12, the mechanism consisting of the molds 41, the guide pins 42 and oscillation levers 43 for oscillating the molds 41 will be described in detail. Mounted on a base or mount 54 are laterally-spaced upright brackets 55 and guide pins 42 over which is fitted for the vertical reciprocal movement an oscillation block 56 having thrust bearings 57. As best shown in FIG. 1, the mold 41 is supported with bolts 58 on one end face of the oscillation block 56 opposite to the brackets 55.

The oscillation lever 43 has its midpoints between the ends pivoted with a pin 59 to the brackets 55 for pivotable movement about the pin 59 and has its one end pivoted with a pin 60 to one end of a link 61 the other end of which is pivoted with a pin 62 to the oscillation block 56. The other end of the oscillation lever 43 is pivoted with a pin 78 to one or upper end of a rod 63 which is swung in a vertical plane by the multi-mold oscillation drive to be described in detail hereinafer with reference to FIG. 13. Since the oscillation block 56 is guided by the guide pins 42, the lateral oscillation of the mold 41 may be prevented and oscillated only in the vertical direction.

Since the mold 41 is supported on the front or rear end face perpendicular to the axis of each strand, no part of the oscillation mechanism is extended laterally outwardly of the mold 41 so that the adjacent strand may be spaced apart from each other by a distance which is equal to a sum of a minimum allowable thickness L″ of the mold 41 and a margin $\alpha$. That is, the adjacent strands may be spaced apart from each other by a distance $(2\,L''+\alpha)$, where $\alpha \approx O$.

Next referring to FIGS. 13, 14 and 15, the mold oscillation drive 44 will be described in detail. As best shown in FIG. 14, a motor 65 is drivingly coupled through a coupling 67, a reduction gear 66 and a coupling 72 to an eccentric cam shaft 68 of a first strand which is supported by roller bearings 70 mounted in bearing boxes 71 and is drivingly coupled through a collar 69 to an eccentric cam shaft 68 in a second strand (the left one in FIG. 14). In like manner, a plurality of eccentric cam shafts 68 in the multi-strand continuous casting machine may be coupled and driven by one motor 65 so that a large number of strands may be installed in parallel with each other in a limited space.

As best shown in FIGS. 13, 14 and 15, laterally spaced upright brackets 73 are securely anchored at a raised position above the base 64, and pivotably supports with pins 75 a swinging or driving lever unit or frame 74. A sliding block 76 U-shaped in cross section (See FIG. 15) is disposed within the lever unit or frame 74 and fitted thereover for slidable movement in the axial or longitudinal direction, and the lower end of the rod 63 is loosely fitted into the sliding block 76 and is pivoted thereto with a pin 77. A hydraulic power cylinder 79 is securely supported on one end wall of the driving lever frame 74 and has its piston rod pivoted to one end of the sliding block 76 so that upon actuation of the power cylinder 79, the sliding block 76 may be reciprocated along the driving frame 74. In order to adjust a position of the sliding block 76, a position adjusting bolt 80 with an adjusting nut 81 and a locking nut 82 is provided at the other end of the driving frame 74. That is, the bolt 80 is screwed into the adjusting nut 81 which in turn is rotatably supported in a wall at the other end of the frame 74 so that upon rotation of the adjusting nut 81, the bolt 80 may be axially displaced toward or away from the other end of the sliding block 76 and may be securely held in a desired position with the locking nut 82, whereby the sliding block 76 may be displaced to and securely locked in a desired position.

As best shown in FIG. 13, the driving lever frame 74 and the eccentric-cam shaft 68 are drivingly interconnected with a link 83. That is, the lower end of the link 83 is fitted over the eccentric cam shaft 68 whereas the upper end is pivoted with a pin 98 to a projection extended downwardly from one side wall adjacent to the other end of the driving lever frame 74 (See FIG. 13). Therefore the driving lever frame 74 oscillates vertically with an amplitude twice as much as an eccentricity $\gamma$ of the eccentric cam shaft 68 in a vertical plane C (See FIG. 13) including the axis of the pin 98. That is, the driving lever frame 74 swings about the pins 75 so that its vertical displacement is transmitted through the sliding block 76, the pins 77 and the rod 63 to the oscillation lever 43.

The vertical stroke of the rod 63 is about $(y/x)\cdot 2\gamma$ when the axis of the pin 77 is at a position indicated by B in FIG. 13, whereas the stroke is zero with the axis of the pin 77 at a position A where the pin 77 is coaxial with the pin 75. This means that the amplitude of vertical oscillation of the lever 43 may be adjusted by the adjustment of the position of the sliding block 76. For instance, when the oscillation of the mold 41 is not required, the axis of the pin 77 of the sliding block 76 is set at the zero-position A so that no oscillation is transmitted to the mold as described above. On the other hand, when the axis of the pin 77 is set at a suitable position right of the position A, the mold 41 may be oscillated with an optimum amplitude. Therefore each of a plurality of molds 41 in the multistrand continuous casting machine may be oscillated with an optimum amplitude including zero amplitude independently from each other and depending upon the casting conditions.

In addition, according to the present invention, angular phase relationship among the eccentricity of eccentric cam carried by the shaft 68 may be suitably adjusted. Therefore the rod 63 is normally pulled upwardly due to the weight of the mold so that the loads exerted to the molds are cancelled and consequently the power of the motor 65 may be considerably reduced as will be described in detail below.

Assume that in a four-strand continuous casting machine the eccentric centers of four eccentric cams, each for each strand, be angularly spaced apart from each other by 90°. Then as shown in FIGS. 16(A) and 16(B), a torque acting on the shaft 68 about the axis of rotation thereof due to the loads of the molds 41 becomes zero. In FIGS. 16(A) and 16(B), the loads of the molds are represented by $P_1$, $P_2$, $P_3$ and $P_4$, the subscripts indicating the strand numbers. Assume that the molds have the same weight and shape. Then, $$P_1 \approx P_2 \approx P_3 \approx P_4$$

and a torque T about the center O of the shaft 68 is given by $$T = P_1 \cdot d + P_2 \cdot C - (P_3 \cdot d + P_4 \cdot C)$$

Substituting into this equation $P = P_1 = P_2 = P_3 P_4$, we have $$T = P\{d + c - (d + c)\{ = 0$$

This suggests that the torque produced by the motor 65 is not necessarily equal to the sum of torques required for oscillating the individual molds and consequently may be less than the sum. It would be obvious to those skilled in the art that an optimum phase relationship among the eccentric centers may be obtained depending upon a number of strands used so that a driving motor with a small power may be used. With the four-strand machine the torque becomes almost zero as described above so that the power requirement is smaller as compared with the motor for oscillating only one mold as shown in FIG. 1. Thus with a less power, many molds may be oscillated each with an optimum amplitude.

Next referring to FIGS. 17 and 18, the pinch roll assembly 49 will be described in detail. The assembly has a stand 84 which rotatably supports the right shaft of a lower pinch roll 49*a* and the left shaft of a hollow lower pinch roll 49*b*. The left shaft of the lower pinch roll 49*a* is rotatably extended through the left pinch roll 49*b* coaxially thereof and beyond one or left side frame of the stand 84 and is drivingly coupled through a first universal shaft 87 to the pinch roller drive (not shown, but indicated as 50 in FIG. 9). A gear 85 supported on the left shaft of the left pinch roll 49*b* is in mesh with a pinion 86 which in turn is drivingly coupled to the pinch roll drive through a second universal shaft 88.

Four upper pinch rolls 94 and 95 are substantially similar in construction so that the description of one roller will suffice. The upper pinch roll 95 is rotatably supported with bearings 97, 96 on a bearing supporting arm 90 with one end pivoted with a pin 91 to the stand 84 and the other end pivoted to a free and of a piston rod of a hydraulic or pneumatic power cylinder 93, 92 mounted on a horizontal beam or gird of the stand 84. Therefore upon actuation of the power cylinder 93, the upper pinch roll 95 may be swung about the pivot pin 91 toward or away from the lower pinch roll 49*b* depending upon the dimensions of the billet 53 being withdrawn and a desired pressure to be exerted thereto.

The multi-strand pinch roll assembly with the above construction has the advantage in that the spacing between the adjacent stand may be decreased to a minimum. In an extreme case, the spacing is such that the adjacent billets 53 are almost made into contact with each other. For instance, with a billet of 120 mm square, the spacing may be reduced to 250 to 300 mm, which is ¼ to 1/5 as compared with the prior art multi-strand continuous casting machine. In addition, the power requirement for driving the pinch rolls may be reduced so that the multi-strand-pinch-roll stand may be made compact in size. Furthermore since the lower pinch rolls 49*a* and 49*b* may be coaxially disposed, the present invention may be also applied to a continuous casting machine having more than three strands.

So far the present invention has been described with particular reference to one preferred embodiment thereof, but it will be understood that the present invention is not limited thereto and that various modifications may be effected without departing from the true spirit thereof.

The advantages and features of the process and apparatus for multi-strand continuous casting in accord with the present invention may be summarized as follows:

(1) Even though the mold oscillation unit and the pinch roll assembly are driven independently of each other, the spacing between the adjacent strands may be considerably reduced as compared with the prior art multi-strand continuous casting machines so that an installation space may be decreased and consequently an initial or installation cost may be reduced.

(2) For a plurality of strands, only one sets of the roller apron or bending unit, the casting bow, the straightener and the run-out table suffice so that parts including spare parts and machining steps for maching them may be considerably decreased in number and consequently significant economical advantages may be attained.

(3) Because of the advantage described in (2), the installation and removal of the apparatus may be much facilitated. In addition, only one unit of oscillation drive is arranged against multi-strand so that an adjusting time may be reduced considerably; the maintenance and adjustments may be much facilitated; and the operation rate of the apparatus may be considerably increased.

(4) Opposed to the prior art twin- or triple casting, the mal-contact between the billet or a cast and the pinch rolls may be prevented and consequently no slip occurs between them.

(5) As a result of the considerable reduction in spacing between the adjacent strands, the tundish may be reduced in length, and even when 6 to 8 strands are used, the division of a tundish is not required. Furthermore, the clogging of nozzles which adversely affects the casting operation may be eliminated.

(6) Since the tundish may be reduced in size, the running cost such as a cost of refractory may be advantageously reduced.

(7) Opposed to the prior art twin- or triple-casting, the pinch rolls in each strand are driven independently of those in other strands so that the casting in each strand may be started at an optimum time independently of the castings in other strands and consequently the continuous casting may be much simplified as compared with the prior art.

(8) Only one prime mover is employed for oscillating a plurality of molds so that parts may be economically reduced in number and the maintenance of the multi-strand mold oscillation unit may be much facilitated. Since only one prime mover or motor is employed, devices and equipment associated therewith may be also reduced in number and an installation space such an electrical equipment room may be considerably reduced.

(9) Because of the smooth onset of the oscillation of the mold, the start and stop of the oscillation of the individual molds may be remote-controlled.

(10) In the mold oscillation unit, the angular phase relationship among the eccentric centers of the eccentric cams for the individual strands may be so determined that the power torque required for driving the unit may be less than the sum of powers or torques required for oscillating the molds in the individual strands. As a consequence, a prime mover or motor with a less power may be advantageously used so that not only the initial cost but also operating cost may be considerably decreased.

(11) The forces acting on the eccentric cam shaft may be balanced by the weights of the molds so that the smooth oscillation of the molds may be ensured.

(12) In the prior art multi-strand continuous casting, a mold oscillation unit for each strand must be designed depending upon the sum of powers each required for operating each strand, but in accordance with the present invention the power requirement for the mold oscillation unit may be decreased so that the whole apparatus may be designed compact in size and consequently the initial cost may be considerably reduced.

What is claimed is:

1. Apparatus for oscillating relative to a fixed support a plurality of parallel molds (41) of a multi-strand continuous casting machine, comprising (a) a plurality of oscillation blocks (56) adapted for connection with said molds, respectively;

(b) means guiding said blocks for vertical displacement relative to the fixed support, including (1) a base member (54);

(2) a plurality of generally vertical fixed guide means (42) rigidly connected with said base member adjacent the molds, respectively, said blocks being connected for vertical displacement on said guide means, respectively;

(c) means for vertically displacing said blocks relative to said guide means, respectively, each of said displacing means including (1) a generally horizontal oscillation lever (43) pivotally connected with said base member;

(2) means (61) for connecting one end of said oscillation lever with said oscillation block;

(3) drive means for pivoting said oscillation levers including (a) a motor (65);

(b) eccentric cam shaft means (68) driven by said motor having a plurality of successive adjustably connected coaxial sections, each of said sections including an eccentricity associated with one of said oscillation levers, respectively, the eccentricities of successive sections being angularly spaced; and (c) means for connecting said cam shaft sections with the other end of each of said oscillation levers, respectively; and (4) said connecting means including (a) a fixed support (64);

(b) a frame (74) pivotally connected with said support about a horizontal pivot axis (75);

(c) a generally vertical link (83) connected at one end with said cam shaft means and at the other end with said frame, whereby rotation of said cam shaft vertically oscillates said frame about said horizontal axis via said link;

(d) sliding block means (76) arranged within said frame, said sliding block means being longitudinally displaced within said frame in response to the vertical oscillations thereof; and (e) generally vertical rod means (63) pivotally connected at its lower end with said sliding block means, the upper end of said rod means being pivotally connected with the other end of said oscillation lever, whereby longitudinal displacement of said sliding block means vertically displaces said rod means to pivot said oscillation levers to vertically oscillate the molds via the vertical displacement of said oscillation blocks on said guide means relative to said fixed support.

2. Apparatus as defined in claim 1, wherein said connecting link means further comprises (f) hydraulic power cylinder means (79) having a piston rod connected with said sliding block means; and (g) adjustable stopper means (80) mounted on said frame, said stopper means being operable to adjust the longitudinal position of said sliding block, said cylinder means biasing said sliding block in a starting position against said stopper means.

* * * * *